US005092301A

United States Patent [19]

Ostdiek

[11] Patent Number: 5,092,301

[45] Date of Patent: Mar. 3, 1992

[54] DIGITAL FUEL CONTROL SYSTEM FOR SMALL ENGINES

[75] Inventor: Arthur J. Ostdiek, Abingdon, Va.

[73] Assignee: Zenith Fuel Systems, Inc., Bristol, Va.

[21] Appl. No.: 479,392

[22] Filed: Feb. 13, 1990

[51] Int. Cl.[5] ..... F02D 41/32

[52] U.S. Cl. ..... 123/480; 123/458; 123/463; 123/488; 123/491; 123/492; 123/493; 123/494; 123/499; 123/DIG. 5; 123/179.17

[58] Field of Search ..... 123/480, 486, 494, 478, 123/488, 458, DIG. 5, 463, 491, 492, 493, 179 G, 179 L, 499

[56] References Cited

U.S. PATENT DOCUMENTS

| | | | |
|---|---|---|---|
| 2,863,433 | 12/1958 | Sarto | 123/445 |
| 3,633,420 | 1/1972 | Holzem | 73/199 |
| 3,794,003 | 2/1974 | Reddy | 123/493 |
| 3,931,802 | 1/1976 | Eckert | 123/455 |
| 3,931,808 | 1/1976 | Rachel | 123/491 |
| 3,935,851 | 2/1976 | Wright et al. | 123/458 |
| 4,141,328 | 2/1979 | Tipton et al. | 417/271 |
| 4,168,688 | 9/1979 | Bart | 123/445 |
| 4,193,299 | 3/1980 | Holzem et al. | 73/199 |
| 4,245,605 | 1/1981 | Rice et al. | 123/492 |
| 4,250,748 | 2/1981 | Wallquist | 73/247 |
| 4,261,314 | 4/1981 | Graessley | 123/480 |
| 4,270,345 | 6/1981 | Kast | 60/39.28 R |
| 4,441,156 | 4/1984 | Barbeau | 364/431.02 |
| 4,495,923 | 1/1985 | Takase et al. | 123/480 |
| 4,535,741 | 8/1985 | Hertz | 123/444 |
| 4,549,515 | 10/1985 | Maisch | 123/452 |
| 4,697,238 | 9/1987 | Barbeau | 364/431.02 |
| 4,747,387 | 5/1988 | Takao et al. | 123/494 |

FOREIGN PATENT DOCUMENTS

| | | | |
|---|---|---|---|
| 58-133433 | 8/1983 | Japan | 123/491 |
| 58-166235 | 10/1983 | Japan | 123/494 |
| 58-192946 | 11/1983 | Japan | 123/491 |
| 59-168229 | 9/1984 | Japan | 123/491 |

*Primary Examiner*—Andrew M. Dolinar
*Attorney, Agent, or Firm*—Remy J. VanOphem

[57] ABSTRACT

A digital fuel control system for a small internal combustion engine having a pressure sensor for detecting the instantaneous pressure in the air intake manifold of the engine to generate air pressure data. A microprocessor responsive to the air pressure data generates a fuel quantity output signal indicative of the quantity of fuel to be delivered to the engine. A fuel metering apparatus responsive to the fuel quantity output signal generated by the microprocessor meters the fuel being delivered to a fuel delivery mechanism which delivers the fuel into the air intake manifold of the engine. The microprocessor in response to the air pressure data generated by the pressure sensor determines the engine's speed and the average pressure of the air inhaled by the engine. The engine speed data and air pressure data address a look-up table to extract data indicative of the fuel requirements of the engine.

33 Claims, 4 Drawing Sheets

DIGITAL FUEL CONTROL SYSTEM FOR SMALL ENGINES

BACKGROUND OF THE INVENTION

1. Field of the Invention

The invention is related to digital fuel control systems for internal combustion engines and in particular to a digital fuel control system for small engines in which the engine's fuel requirements are determined from the fluctuations of the air pressure in the engine's air intake manifold.

2. Description of the Prior Art

In electronically controlled fuel injection systems, the quantity of fuel being delivered to the engine is computed as a function of the quantity of air being inhaled. Most of the fuel control systems currently being used in the automotive industry compute the quantity of air being inhaled by the engine from the engine's speed and the pressure of the air in the air intake manifold of the engine. Typical examples of such fuel control systems are taught by Sarto, U.S. Pat. No. 2,863,433, Taplin et al, U.S. Pat. No. 3,789,816, as well as Graessley, U.S. Pat. No. 4,261,314.

In a similar manner, Bianchi et al, U.S. Pat. No. 4,172,433, teaches a fuel control system in which the fuel quantity is determined from the engine speed and the position of the throttle blade in the throttle body.

In contrast to the prior art described above, Eckert, U.S. Pat. No. 3,931,802, discloses an electronic fuel control system which directly measures the air flow rate through the engine's air intake manifold and does not require an independent measurement of the engine's speed to determine the quantity of fuel to be delivered to the engine.

The disclosed digital fuel control system is different from the fuel control systems taught by the prior art discussed above. Like the Eckert patent, the disclosed digital fuel control system uses a single sensor to measure the quantity of air being inhaled by the engine. As shall be described herein, the output of the engine's sensor provides the information necessary to determine the speed of a small engine and the average air pressure in the air intake manifold of the engine.

SUMMARY OF THE INVENTION

The invention is a fuel control system for a small internal combustion engine having up to four cylinders and a pressure sensor generating pressure data indicative of the instantaneous pressure in the engines's air intake manifold. A microprocessor generates a fuel quantity signal indicative of the engine's fuel requirements in response to the instantaneous air pressure data. A fuel metering means meters the desired quantity of fuel to the engine in response to the fuel quantity signal generated by the microprocessor. A fuel delivery means connected to the fuel metering means delivers the metered quantity of fuel into the engine's air intake manifold. The fuel delivery means may be a fuel injector or spray mechanism which atomizes the metered quantity of fuel delivered to the air intake manifold.

In the preferred embodiment, the microprocessor detects preselected states of the air pressure data to generate period data indicative of the time required for the engine to execute a full operational cycle. The microprocessor also detects a preselected pressure value indicative of an average air pressure in the engine's air intake manifold. The microprocessor addresses a look-up table with the value of the period data and the value of the preselected pressure to extract from the look-up table fuel quantity data having a value indicative of the engine's fuel requirements.

The object of the invention is a simple fuel control system for a small engine requiring only a pressure sensor for determining the engine's fuel requirements.

Another object of the invention is a fuel control system in which the engine's speed and average air intake pressure can be determined from the wave form generated by a pressure sensor monitoring the pressure in the air intake manifold.

Another object of the invention is the use of the period data and preselected intake manifold pressure data to address a look-up table storing the data indicative of the engine's fuel requirements as a function of the engine's period and the preselected pressure value.

Still another object of the invention is to use a solenoid actuated fuel pump to meter the desired quantity of fuel to the engine.

Yet another object of the invention is to use a variable orifice in combination with an impulse pump to meter the desired quantity of fuel to the engine.

These and other objects of the invention will become apparent from a reading of the detailed description of the invention in conjunction with the drawings.

DETAILED DESCRIPTION OF THE PREFERRED EMBODIMENT

Figure 1:
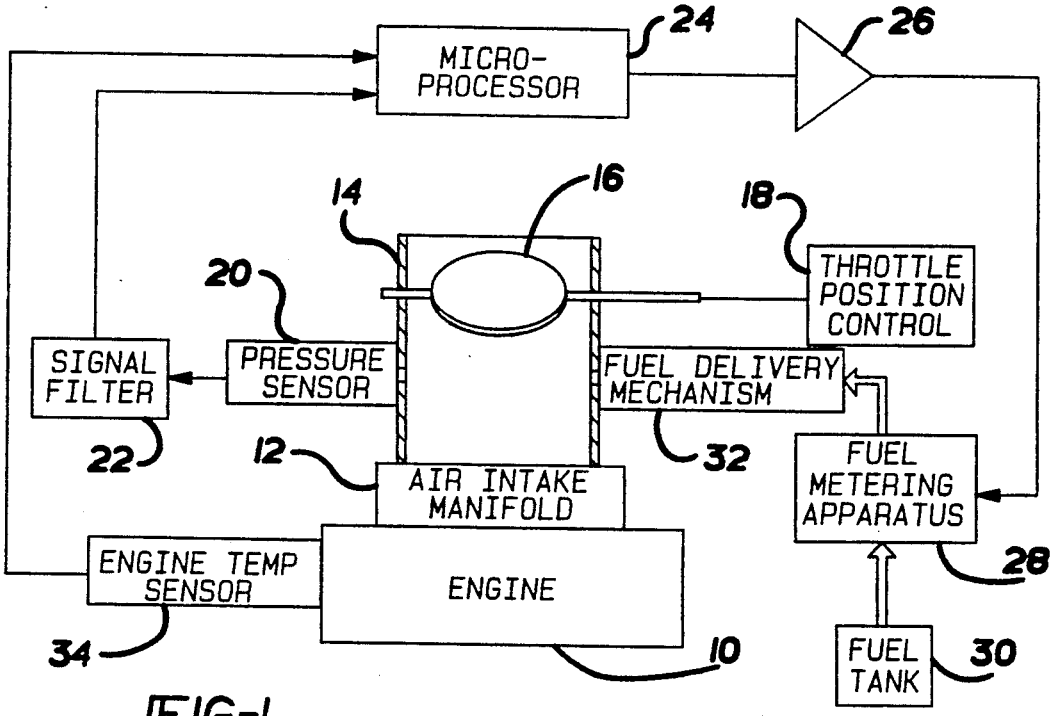
FIG. 1 is a block diagram of the digital fuel control system.

FIG. 1 is a block diagram of a digital fuel control system for a small internal combustion engine 10. The small engine 10 may have one or more cylinders and may be of the two cycle of four cycle type. In the discussions that follow, it will be assumed that the engine is a four cycle engine in which the air intake valve is opened once during every other revolution of the engine's crankshaft. The engine 10 has an air intake manifold 12 which includes a throttle body 14. A throttle blade 16 is disposed in the throat of the throttle body 14 and controls the quantity of air being inhaled by the engine 10. As is well known in the art, the quantity of air and, therefore, the rotational speed of the engine 10 is, along with other factors, determined by the rotational position of the throttle blade 16.

The rotational position of the throttle blade 16 is controlled by a throttle position control 18. The throttle position control 18 may be a conventional hand actuated lever or foot actuated pedal mechanically linked to the throttle blade 16. Alternatively, the throttle position control 18 may be a mechanical speed governor or a closed loop engine speed control system similar to the cruise control systems currently used in automotive vehicles. These closed loop engine control systems electrically control the rotational position of the throttle blade 16 to maintain the engine speed at a preselected value. The various types of throttle position controls 18 described above are well known in the art and, therefore, need not be discussed in detail for an understanding of the invention.

Figure 2:
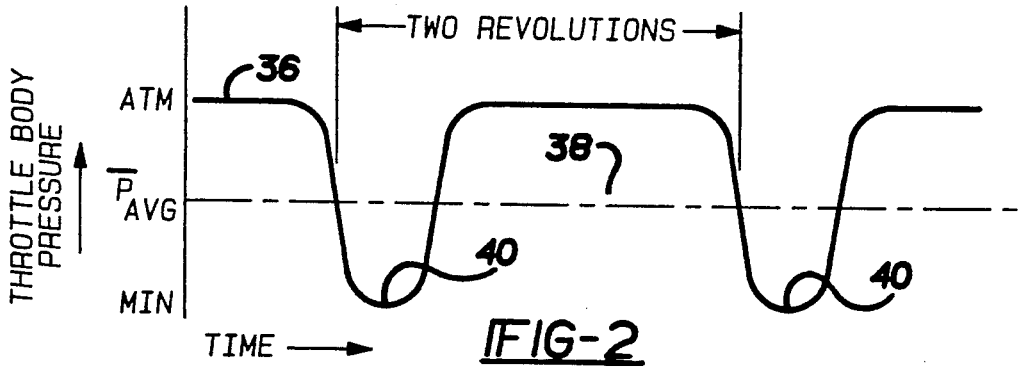
FIG. 2 is a wave form of the output of a pressure sensor measuring the intake manifold pressure of a single cylinder engine.
Figure 3:
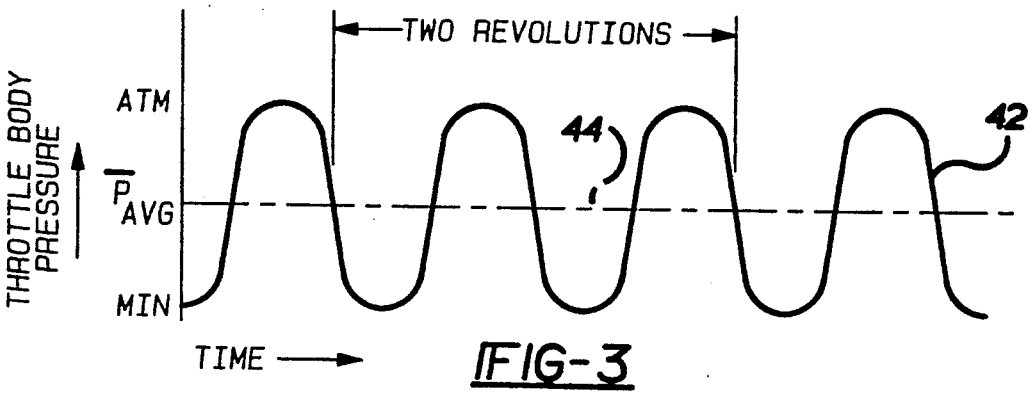
FIG. 3 is a wave form of the output of a pressure sensor measuring the air intake manifold pressure of a two cylinder engine.

A pressure sensor 20 detects the air pressure in the air intake manifold 12 intermediate the throttle blade 16 and the engine 10. The pressure sensor 20 generates an electrical signal indicative of the instantaneous air pressure in the air intake manifold 12. This electrical signal is filtered by a signal filter 22 to remove the high frequency components prior to being transmitted to a microprocessor 24. The fluctuation of the air pressure in the air intake manifold 12 as a function of time for a single cylinder four cycle engine is shown in FIG. 2 while the fluctuation of the air pressure as a function of time for a two cylinder four cycle engine is shown in FIG. 3. For an opposed piston engine having four cylinders, the wave forms of the fluctuation of the air pressure in the intake manifold would be comparable to the wave form shown in FIG. 3.

Referring first to FIG. 2, the time required for a single cylinder engine to execute a complete operational cycle which is equal to two revolutions of the engine's crankshaft may readily be measured from a wave form 36. The time required for the engine to complete one operational cycle is the time between two sequential occurrences of a preselected condition, for example, when the pressure in the air intake manifold 12 is decreasing and becomes equal to an average or medial value $P_{avg}$ indicated by line 38 intermediate the maximum and minimum values of the wave form 36. However, other conditions such as the occurrence of a minimum pressure value, such as valleys 40 of the wave form 36, may be used as the preselected condition.

The time required for a two cylinder engine to make a complete revolution may readily be measured from the wave form 42 shown in FIG. 3. As with the single cylinder engine, a complete revolution of the engine's crankshaft may be detected when the pressure in the throttle body is decreasing and becomes equal to the average or medial value $P_{avg}$ indicated by line 44 during the intake stroke of the same cylinder.

At the engine's operating temperature, the throttle body pressure wave forms 36 or 42 provide the microprocessor 24 with all the information necessary to determine the quantity of fuel required for the efficient operation of the engine. From the time required for the engine to complete an operational cycle, the time of the air intake stroke can be computed and from the maximum and minimum pressures an average pressure of the air being inhaled by the engine can be determined. Knowing the dynamics of a particular engine, the quantity of air inhaled during each intake stroke can, therefore, be determined from the instantaneous values of the pressure in the air intake manifold. Once the quantity of air being inhaled is known, the proper quantity of fuel required for the efficient operation of the engine may be determined.

Digital data indicative of the quantity of fuel required by the engine may be stored in a look-up table accessible to the microprocessor 24. This look-up table may be addressed by the period of time required for the engine to complete an operational cycle (engine's speed) and the data indicative of the average value of pressure in the air intake manifold. It has been found that the minimum pressure in the air intake manifold may be used as a pressure indicative of the average value of the pressure of the air being inhaled by the engine.

The fuel quantity data output of the look-up table is then converted to an output signal having a format adapted to control the quantity of fuel being supplied to the engine by a fuel metering apparatus 28. The output signal from the microprocessor 24 to the fuel metering apparatus 28 may be a variable frequency signal or a pulse width modulated signal depending upon requirements of the fuel metering apparatus 28. A buffer amplifier 26 may be disposed between the microprocessor 24 and the fuel metering apparatus 28 to isolate the output of the microprocessor 24 from the extraneous noise that may be generated by the fuel metering apparatus 28 and to increase the power level of the output signal generated by the microprocessor.

The fuel metering apparatus 28 provides a metered quantity of fuel from a fuel source, such as a fuel tank 30 to a fuel delivery mechanism 32, in response to the output signal generated by the microprocessor. The fuel delivery mechanism 32 injects or sprays the metered quantity of fuel into the air intake manifold 12 of the engine 10. The fuel delivery mechanism 32 may deliver the fuel into the throttle body 14 below the throttle blade 16 as shown, but alternatively may deliver the fuel into the throttle body above the throttle blade 16 as is commonly done in some of the conventional single point automotive fuel injection systems. Alternatively, the fuel delivery mechanism 32 may inject the fuel directly into the input port of the cylinder or cylinders as is common practice with conventional multi-point fuel injection systems which have an individual fuel injector valve for each cylinder.

The digital fuel control system also includes an engine temperature sensor 34 whose output is used to determine the quantity of fuel required to facilitate starting of a cold engine and to enhance the quantity of fuel being delivered to the engine prior to the engine reaching a normal operating temperature range.

Figure 4:
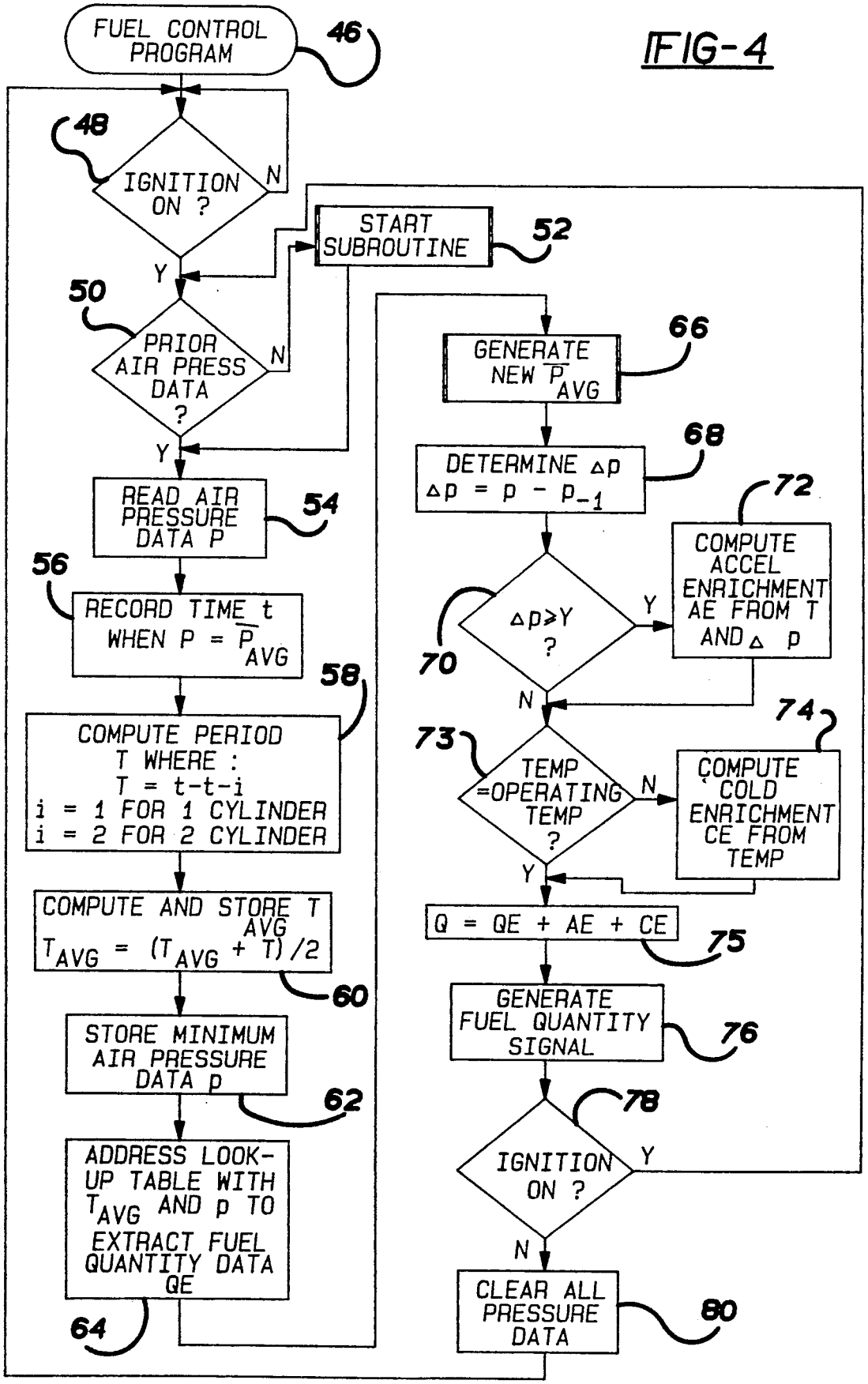
FIG. 4 is a flow diagram of the fuel control program executed by the microprocessor 24.
Figure 5:
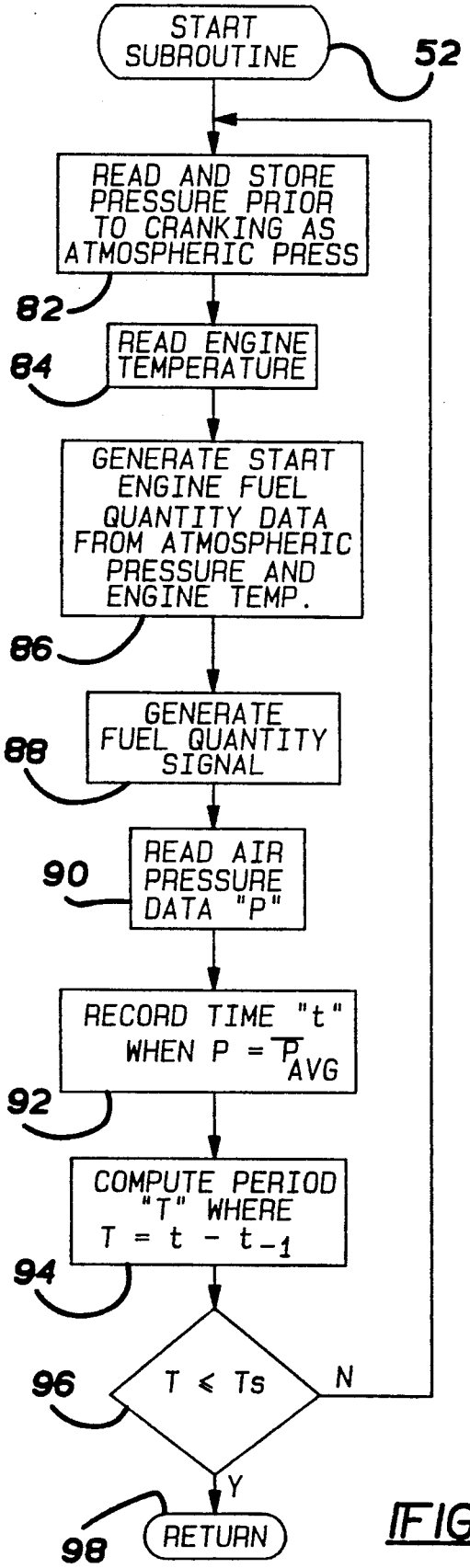
FIG. 5 is a flow diagram of the start subroutine.
Figure 6:
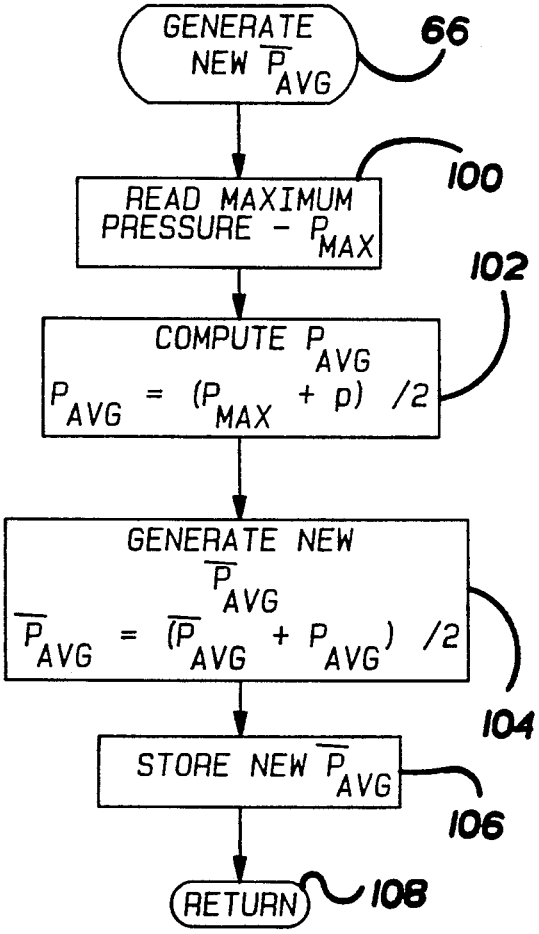
FIG. 6 is a flow diagram of the compute new $P_{avg}$ subroutine.

The operation of the digital fuel control system will be discussed relative to the flow diagram shown in FIGS. 4 through 6. FIG. 4 is a flow diagram of the basic fuel control program executed by the microprocessor 24 in computing the quantity of fuel to be delivered to the engine as a function of the engine's period "T" which is the reciprocal of the engine speed and the minimum pressure "p" measured during the air intake stroke of the engine. FIG. 5 is the start subroutine executed by the microprocessor 24 to provide a richer than normal fuel air mixture during the starting procedure and FIG. 6 is a flow diagram of the computer new $P_{avg}$ subroutine for computing the average pressure $\overline{P}_{avg}$ for the next cycle.

Referring to the flow diagram shown in FIG. 4, the fuel control program 46 first inquires, decision block 48, if the ignition switch is on. If it is not on, the fuel control program 46 will wait until the ignition is turned on.

After the ignition is turned on, the microprocessor 24 will interrogate the air pressure data registers to determine if there is prior air pressure data as indicated by decision block 50. The absence of prior air pressure data indicates that the engine is not running and, therefore, the program will call up the start subroutine 52, the details of which are described relative to the flow diagram shown in FIG. 5.

If prior air pressure data exists, the microprocessor 24 will proceed to read the current air pressure data P being generated by the pressure sensor 20 as indicated by block 54. The microprocessor will then record the time "t" when the pressure in the engine's air intake manifold 12 becomes equal to or crosses an average pressure value $\overline{P}_{avg}$ while it is decreasing from its maximum value towards a minimum value, as indicated in block 56. The average pressure value $\overline{P}_{avg}$ is indicative of a pressure which is preferably half way between the maximum pressure and the minimum pressure values as shown by lines 38 and 44 in FIGS. 2 and 3, respectively.

The microprocessor 24 will then compute the current engine's period "T", block 58, indicative of the time required for the engine to complete a full operational cycle. The period "T" is the time required between two sequential occurrences of the same event, and in the instant example is the time between sequential crossings of the average pressure $\overline{P}_{avg}$ by the pressure measured by the pressure sensor 20 as the pressure in the air intake manifold decreases from its maximum value towards its minimum value. Effectively, the period "T" is equal to $t-t_{-i}$ where $t_{-i}$ is the preceding time t and i has the value of 1 for a single cylinder engine or a value of 2 for a two cylinder engine. As discussed relative to FIG. 3, the air pressure in the throttle body 14 of a two cylinder engine will decrease during the intake stroke of each cylinder. Therefore, the period "T" is the time between every other occurrence of the pressure P crossing the average pressure $\overline{P}_{avg}$ as it descends from its maximum pressure value towards its minimum pressure value. Alternatively, as is known in the art, the period "T" may be determined from the shape of the pressure wave having a predetermined value rather than detecting when the pressure is equal to an average value as by detecting any other predetermined state of the pressure wave.

The microprocessor will then compute and store the average period $T_{avg}$ of the engine as indicated in block 60 by summing the current period "T" with the preceding average period $T_{avg}$ then dividing by 2 to generate a new average period value.

The average period, $T_{avg}$, can be a simple arithmetic average with a prior value as indicated above or may be a more complicated calculation based on a greater time history, as well as methods which extrapolate from prior data into the future as a first order correction for a time lag in the fuel delivery system. The nature of the algorithm for computing the average period will depend on the availability of random access memory and the stability of the various loops in the control system. The computed average period is then stored for subsequent use in computing the average period for the next operational cycle. The microprocessor will next find the minimum air pressure "p" as indicated by block 62, then address a look-up table storing data indicative of the engine's fuel requirements as a function of the minimum air pressure "p" and the average period $T_{avg}$ to extract the fuel quantity data QE, as indicated by block 64. The microprocessor will then generate, block 66, a new value for the average pressure $\overline{P}_{avg}$ which is stored for subsequent use in calculating the period of the next operational cycle.

To determine if acceleration enrichment is required, the microprocessor 24 will determine the differential minimum pressure $\Delta p$, block 68, which is the difference between the current minimum pressure p and the preceding minimum pressure $p_{-i}$ during the intake stroke of the same cylinder where i is 1 for a single cylinder engine and 2 for a two cylinder engine. It will then inquire decision block 124 if $\Delta p$ is equal to or greater than 0. If $\Delta p$ is equal to or greater than 0, it will next inquire, decision block 70, if $\Delta p$ is greater than a predetermined value "Y". A positive increase in the value of p greater than a predetermined value "Y" which is greater than the nominal fluctuations of the value of $\Delta p$ is considered to be a demand from the throttle position control 18 for an increase in speed. Therefore, when $\Delta p$ exceeds the predetermined value "Y", it will comput an acceleration enrichment increment AE as indicated by block 72 then proceed to inquire, decision block 73, if the engine has reached its operating temperature.

Those skilled in the art will recognize that a decrease in the value of the differential pressure $\Delta p$ greater than a predetermined value corresponds to a deceleration command. The microprocessor's program may include a deceleration subroutine which is converse of the acceleration enrichment subroutine described above.

The deceleration subroutine is called up, decision block 126, in response to a decrease in the differential pressure $\Delta p$ being greater than the predetermined value X. In this subroutine, the microprocessor 24 will extract from the look up table deceleration fuel quantity data having a value approximately equal to or less than the value which corresponds to the fuel quantity QI required to sustain the engine in an idle state as indicated by block 128, then proceed to generate a fuel quantity signal, as indicated by block 76, using the idle fuel quantity data QI. As is known in the art, the value of the deceleration fuel quantity data may be a function of engine speed such that as the engine's speed approaches idle speed the fuel quantity is increased slightly to prevent the engine from stalling.

If in decision block 126, $\Delta p$ is not equal to or greater than X, the microprocessor 24 will then inquire, block 73, if the temperature of the engine has reached it operating temperature since it was started. If the engine is still cold, the microprocessor 24 will compute a cold enrichment increment CE, as indicated in block 74, which is required to sustain the operation of a cold engine. The cold enrichment increment provides the same effect as an automatic choke for a carbureted engine. The fuel quantity data QE extracted from the look-up table, the acceleration enrichment increment AE, and the cold enrichment increment CE are then summed, block 75, to generate a composite fuel quantity data Q which is used to generate the fuel quantity signal as indicated by block 76. However, if the value of $\Delta p$ is less than "Y" no acceleration enrichment is required and the microprocessor will generate the desired fuel quantity signal based on the value of QE extracted from the look-up table and the cold enrichment CE if necessary. Likewise, if the engine is within normal operating temperature range, no cold enrichment increments CE will be generated and the microprocessor will generate the fuel quantity signal based on the value of QE extracted from the look-up table and the acceleration enrichment increment AE if required. After generating the desired fuel quantity signal Q, the microprocessor will inquire, decision block 78, if the ignition is still on. If it is on, the program will return to decision block 50 and generate a new fuel quantity signal for the next engine cycle. If the ignition is turned off, the microprocessor will clear all air pressure data from its registers and files, as indicated by block 80, so to assure that the microprocessor will call up the start subroutine 52 the next time the ignition is turned on. After clearing the air pressure data, the program will return to block 48 and wait for the ignition to be turned back on.

The details of the start subroutine 52 executed by the microprocessor 24 are disclosed in the flow diagram shown in FIG. 5. Upon entering the start subroutine 52, the microprocessor 24 will read and store the air pressure in the throttle body 14 prior to cranking the engine as indicated by block 82. This pressure prior to cranking is atmospheric pressure. The microprocessor will then read and store the engine's temperature, block 84, as detected by the engine's temperature sensor 34, then generate the start engine fuel quantity data from the atmospheric pressure and engine temperature data as indicated by block 86. The microprocessor 24 will then generate a fuel quantity signal from the start engine fuel quantity data, block 88, which is transmitted to the fuel metering apparatus to supply the engine with a quantity of fuel needed to start the engine.

The subroutine will then direct the microprocessor to read the air pressure data generated by the pressure sensor, block 90, then compute the period "T", blocks 92 and 94, in the same manner as described relative to blocks 56 and 58 of FIG. 4.

The microprocessor will then inquire, decision block 96, if the period "T" is smaller than a predetermined value $T_s$ to determine if the engine is running on its own power or is still being cranked. The value of $T_s$ is preselected to be longer than the engine's period when the engine is idling but shorter than the engine's period when the engine is being cranked by the starter motor. Therefore, if "T" is greater than $T_s$ the engine is not running under its own power. However, once the engine starts, "T" will become smaller than $T_s$ and the start subroutine is terminated as indicated by termination block 98.

The compute new $\overline{P}_{avg}$ subroutine 66 is shown in the flow diagram of FIG. 6. The compute new $\overline{P}_{avg}$ subroutine 66 begins by reading the maximum pressure $P_{max}$ in the throttle body between intake strokes, as indicated by block 100, then dividing by 2 the sum of $P_{max}$ and the minimum pressure p to generate an average pressure value $P_{avg}$ as indicated by block 102, where $P_{avg}=(P_{max}+p)/2$.

The microprocessor will then sum the new average pressure value $P_{avg}$ with the prior average valve $\overline{P}_{avg}$ then divide by 2 to generate a new average value $\overline{P}_{avg}$, as indicated by block 104, then store the new average value $\overline{P}_{avg}$, block 106, for use in determining the times "T" during the next engine cycle. The subroutine will return to the fuel control program 46 as indicated by block 108. It is recognized that more elaborate methods may be used to calculate the average pressure. One method would be to store the entire wave form then integrate the stored data to generate an average or medial pressure value. Other methods known in the art are also applicable to calculate the average pressure.

Figure 7:
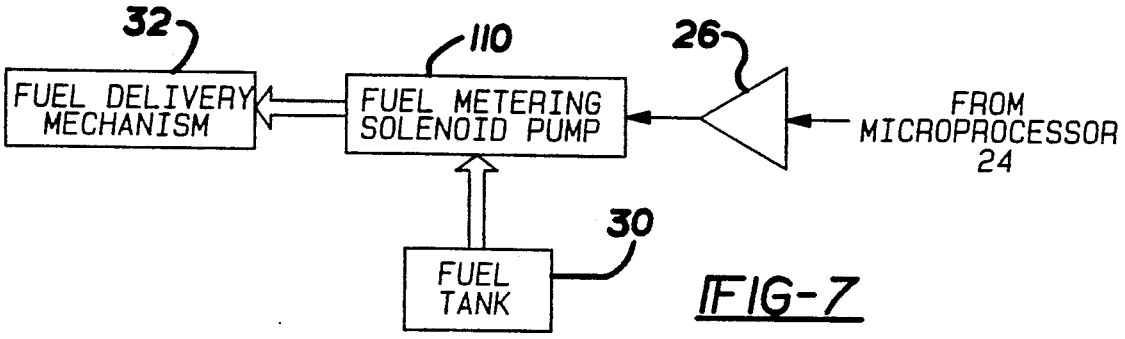
FIG. 7 is a block diagram of a first embodiment of the fuel metering apparatus having a solenoid actuated pump.
Figure 8:
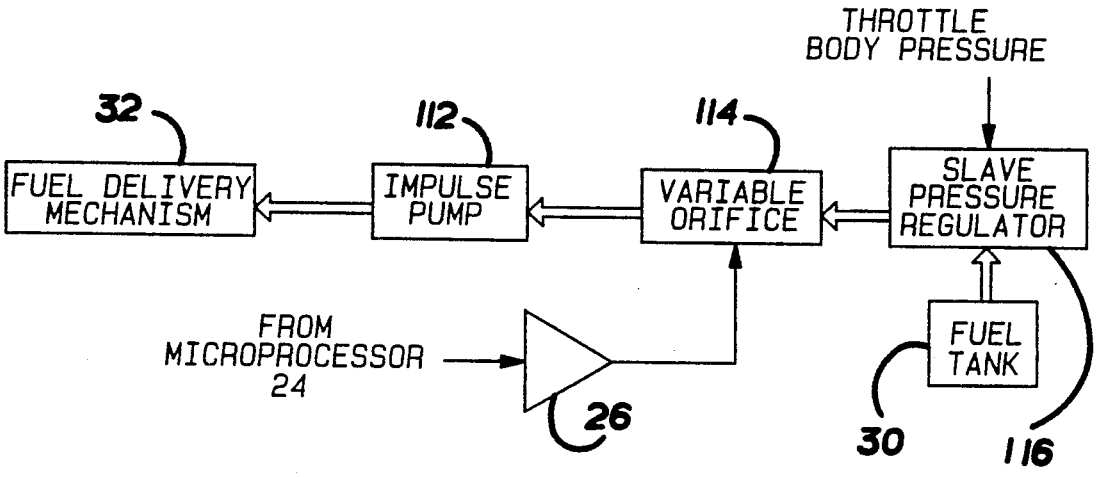
FIG. 8 is a block diagram of a second embodiment of the fuel metering apparatus having an impulse pump and variable orifice.
Figure 9:
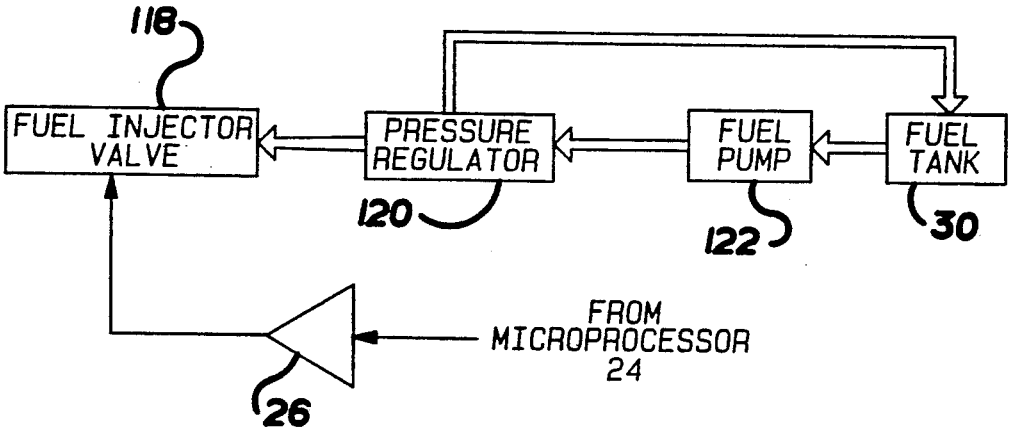
FIG. 9 is a block diagram of a third embodiment of the fuel metering apparatus having a fuel pump and a fuel injector valve.

The fuel metering apparatus may take various forms as indicated by the embodiments shown in FIGS. 7 through 9. As shown in FIG. 7, the fuel metering apparatus 28 may be a solenoid actuated fuel metering pump 110 of the type disclosed by Ralph V. Brown in U.S. Pat. No. 4,832,583, in which the signal energizing the pump's solenoid coil is the signal generated by the microprocessor 24 received from the buffer amplifier 26. A pulse width modulated signal periodically energizes the solenoid coil to displace the piston during the cocking stroke a distance which is a known function of the width of the pulse width modulated fuel quantity signal. Therefore, the quantity of fuel delivered during each pumping stroke is a function of the width of the pulses in the pulse width modulated signal.

Alternatively, a variable frequency fuel quantity signal having a frequency greater than the natural full stroke frequency of the pump can be used to meter the fuel being delivered to the engine. Since the magnetic force generated by the solenoid coil to retract the piston during the cocking stroke is a non-linear function of the piston's position relative to the solenoid coil, a variable frequency signal can cause the piston to reciprocate at different locations along its path. At the lower frequencies the piston will be retracted proportionally a greater distance than it would be at a higher frequency due to the increase in the magnetic force acting to retract the piston as a greater portion of its length is received in the solenoid coil. Therefore, the fuel delivery rate of the solenoid pump will be an inverse function of the solenoid coil excitation frequency when the excitation frequency is greater than the natural full stroke frequency of the pump.

An alternate embodiment of the fuel metering apparatus is shown in FIG. 8. In this embodiment, the fuel is pumped into the fuel delivery mechanism 32 by an impulse pump 112 actuated by the pressure variations in the engine's air intake manifold or crankcase, such as impulse pump, part no. B670 manufactured by Facet Enterprises, Inc. The quantity of fuel delivered to the engine is controlled by a variable orifice 114 responsive to the fuel quantity signals generated by the microprocessor 24 and amplified by the buffer amplifier 26. To prevent extraneous fuel from being siphoned through the impulse pump 112 and the variable orifice 114 by the reduced pressure in the throttle body 14, a slave pressure regulator 116 is disposed between the variable orifice 114 and the fuel tank. The slave pressure regulator 116 is pneumatically connected to the throttle body and regulates the pressure at the input of the impulse pump 112 to be approximately equal to the pressure in the throttle body. This arrangement reduces the pressure differential across the impulse pump 112 and the variable orifice 114, effectively eliminating any siphoning action that otherwise might have occurred due to the reduced pressure in the throttle body or air intake manifold. Those skilled in the art will recognize that the variable orifice 114 which controls the quantity of fuel being injected into the engine may alternatively be disposed between the impulse pump 112 and the fuel delivery mechanism 32 rather than before the impulse pump 112 as shown in FIG. 8 without affecting the operation of the fuel metering apparatus.

Alternatively, as shown in FIG. 9, the fuel delivery mechanism 32 may be a fuel injector valve 118 which meters the fuel to the engine in response to the fuel quantity signal generated by the microprocessor 24. The fuel from the fuel tank 30 is pressurized by a fuel pump 122. A pressure regulator 120 controls the pressure of the fuel received by the fuel injector valve 118 so that the quantity of fuel delivered by the fuel injector valve 118 is only a function of the width of the pulse width modulated fuel quantity signal.

Although the best mode contemplated by the inventor for carrying out the present invention as of the filing data hereof has been shown and described herein, it will be apparent to those skilled in the art that suitable modifications, variations, and equivalents may be made without departing from the scope of the invention, such scope being limited solely by the terms of the following claims.

What is claimed is:

1. A digital fuel control system for a small internal combustion engine having at least one cylinder and an air intake manifold comprising:

a pressure sensor for detecting the instantaneous pressure in said air intake manifold to generate air pressure data, said air pressure data containing engine speed data and intake manifold pressure data indicative of the instantaneous air pressure in said air intake manifold;

a microprocessor responsive to said engine speed data and said intake manifold pressure data for generating a fuel quantity output signal indicative of a quantity of fuel to be delivered to said engine; and fuel metering means for metering said quantity of fuel to said engine in response to said fuel quantity output signal.

2. The digital fuel control system of claim 1 wherein said microprocessor comprises:

period means for detecting preselected states of said air pressure data to generate period data indicative of the time required for said engine to complete an operational cycle;

means for detecting a preselected pressure value indicative of an average pressure in said air intake manifold;

a look-up table storing fuel quantity data indicative of the fuel requirements of said engine as a function of said period data and said preselected pressure value;

means for addressing said look-up table with said period data and said preselected pressure value to extract said fuel quantity data; and output signal generator means for generating said fuel quantity output signal in response to said fuel quantity data extracted from said look-up table.

3. The digital fuel control system of claim 2 wherein said air pressure data includes a maximum pressure value and a minimum pressure value, said period means for detecting a preselected state of said air pressure data comprises:

means for generating a medial pressure value intermediate said maximum and minimum pressure values; and means for measuring the time between the sequential occurrences of said air pressure data having a predetermined relationship to said medial pressure value to generate said period data.

4. The digital fuel control system of claim 3 wherein said engine is a single cylinder engine, said means for measuring measures the time between sequential occurrences of said predetermined relationship.

5. The digital fuel control system of claim 4 wherein said predetermined relationship is when the value of said air pressure data becomes equal to said medial pressure value when the value of said air pressure data is decreasing from said maximum pressure value towards said minimum pressure value.

6. The digital fuel control system of claim 3 wherein said engine is a two cylinder engine, said means for measuring measures the time between every other sequential occurrence of said predetermined relationship.

7. The digital fuel control system of claim 6 wherein said predetermined relationship is when said value of said air pressure data becomes equal to said medial pressure value when said value of said air pressure data is decreasing from said maximum pressure value towards said minimum pressure value.

8. The digital fuel control system of claim 3 wherein said means for detecting a preselected pressure value selects said minimum pressure value.

9. The digital fuel control system of claim 2 wherein said output signal generator means is a pulse width modulated pulse generator for generating output pulses having a pulse width controlled by said fuel quantity data.

10. The digital fuel control system of claim 2 wherein said output signal generator means is a variable frequency oscillator generating a variable frequency fuel quantity output signal the frequency of which is controlled by said fuel quantity data extracted from said look-up table.

11. The digital fuel control system of claim 1 wherein said fuel metering means comprises a solenoid actuated metering fluid pump providing a metered quantity of fuel to a fuel delivery mechanism in response to said fuel quantity output signal.

12. The digital fuel control system of claim 1 wherein said engine has a crankcase and wherein said fuel metering means comprises:

a fuel delivery mechanism for delivering fuel into said air intake manifold;

an impulse pump for providing fuel to said fuel delivery mechanism in response to the fluctuation of the air pressure in said crankcase; and a variable orifice connected to said impulse pump for controlling the quantity of fuel being provided to said fuel delivery mechanism by said impulse pump in response to said fuel quantity output signal.

13. The digital fuel control system of claim 12 wherein said fuel metering means further comprises a slave pressure regulator responsive to the pressure in said air intake manifold to control the pressure of the fuel being provided to said impulse pump to be approximately equal to the air pressure in said air intake manifold.

14. The digital fuel control system of claim 1 wherein said fuel metering means comprises:

a fuel pump to supply fuel under pressure;

a fuel injector valve for metering the quantity of fuel injected into said air intake manifold in response to said fuel quantity output signal; and a pressure regulator for controlling the pressure of the fuel received by said fuel injector valve from said fuel pump.

15. The digital fuel control system of claim 3 wherein said digital fuel control system includes a temperature sensor generating engine temperature data indicative of the temperature of said engine and wherein said pressure sensor generates air pressure data indicative of atmospheric pressure in between air intake strokes of said engine during cranking of said engine, said microprocessor further comprising means responsive to an engine being started to generate digital start fuel quantity data having a value determined by said engine temperature data and said air pressure data indicative of atmospheric data necessary to effect starting of said engine, and wherein said output signal generator means generates said fuel quantity output signal in response to said start fuel quantity data.

16. The digital fuel control system of claim 15 further including means responsive to a change in said air pressure data indicative of a command to increase the engine's speed for generating an acceleration fuel quantity enrichment increment and wherein said output signal generator means generates said fuel quantity output signal in response to a sum of said fuel quantity data and said fuel quantity enrichment increment.

17. The digital fuel control system of claim 15 further including means responsive to a change in said air pressure data indicative of a command to decrease the engine's speed for generating deceleration fuel quantity data having a value approximately equal to a value of said fuel quantity data required to sustain the engine at an idle speed and wherein said output signal generator means generates said fuel quantity output signal in response to said deceleration fuel quantity data.

18. A method for controlling the fuel to an internal combustion engine having at least one cylinder and an air intake manifold comprising the steps of:

detecting the instantaneous air pressure in said air intake manifold to generate air pressure data, said air pressure data containing engine speed data and intake manifold pressure data indicative of the instantaneous air pressure in said air intake manifold;

generating a fuel quantity signal in response to said engine speed data and intake manifold pressure data indicative of a quantity of fuel to be delivered to said engine; and precisely metering said quantity of fuel to be delivered into said air intake manifold in response to said fuel quantity signal.

19. The method of claim 18 wherein said step of generating a fuel quantity signal comprises the steps of:

detecting preselected states of said air pressure data to generate period data indicative of the time required for each complete operational cycle of said engine;

detecting a preselected pressure value from said air pressure data indicative of an average pressure in said air intake manifold;

addressing a look-up table with said period data and said preselected pressure value to extract fuel quantity data, said look-up table storing said fuel quantity data as a function of said period data and said preselected pressure value; and generating said fuel quantity output signal in response to said fuel quantity data extracted from said look-up table.

20. The method of claim 19 wherein said air pressure data includes a maximum pressure value and a minimum pressure value, said step of detecting preselected states of said air pressure data comprises the steps of:

generating a medial pressure value intermediate said maximum and minimum pressure values; and measuring the time between the sequential occurrences of said air pressure data having a predetermined relationship to said medial pressure value to generate said period data.

21. The method of claim 20 wherein said engine is a single cylinder engine, said step of measuring measures the time between sequential occurrences of said predetermined relationship.

22. The method of claim 21 wherein said step of measuring the time between sequential occurrences of said predetermined relationship comprises the step of measuring the time between the sequential occurrences when the value of said air pressure data becomes equal to said predetermined medial pressure value when the value of said air pressure data is decreasing from said maximum pressure value towards said minimum pressure value.

23. The method of claim 20 wherein said engine is a two cylinder engine, said step of measuring measures the time between every other sequential occurrence of said predetermined relationship.

24. The method of claim 23 wherein said step of measuring the time between every other sequential occurrence of said predetermined relationship comprises the step of measuring the time between every other sequential occurrence when the value of said air pressure data becomes equal to said medial pressure value when the value of said air pressure data is decreasing from said maximum pressure value towards said minimum pressure value.

25. The method of claim 20 wherein said step of detecting a preselected pressure value selects said minimum pressure value.

26. The method of claim 19 wherein said step of generating said fuel quantity output signal generates a pulse width modulated output pulse signal, the pulse width of which is determined by said fuel quantity data.

27. The method of claim 19 wherein said step of generating said fuel quantity output signal generates a frequency modulated signal, the frequency of which is determined by said fuel quantity data.

28. The method of claim 18 wherein said step of precisely metering comprises the step of actuating a solenoid actuated metering fluid pump with said fuel quantity signal and injecting said metered fuel quantity into said air intake manifold.

29. The method of claim 18 wherein said step of precisely metering comprises the steps of:

actuating an impulse pump to provide fuel to said engine;

actuating a variable orifice associated with said impulse pump with said fuel quantity signal to control said quantity of fuel being provided to said engine; and injecting the metered quantity of said fuel into said air intake manifold.

30. The method of claim 29 wherein said step of precisely metering further includes the step of controlling the pressure at the input of said impulse pump to be equal to the pressure in said air intake manifold.

31. The method of claim 18 further comprising the steps of:

detecting the temperature of said engine to generate engine temperature data;

detecting the pressure in said air intake manifold prior to cranking the engine to generate atmospheric pressure data;

detecting from said air pressure data that said engine is not running under its own power to generate a start engine command;

generating start fuel quantity data from said engine temperature data and said atmospheric pressure data in response to said start engine command; and generating said fuel quantity signal in response to said start fuel quantity data.

32. The method of claim 18 further comprising the steps of:

detecting a first change in said air pressure data indicative of a command to increase the speed of said engine to generate an acceleration command;

generating an acceleration fuel quantity enrichment increment in response to said acceleration command;

summing said fuel quantity data and said acceleration fuel quantity enrichment increment to generate sum data; and generating said fuel quantity signal in response to said sum data.

33. The method of claim 18 further comprising the steps of:

detecting a second change in said air pressure data indicative of a command to decrease the speed of said engine to generate a deceleration command;

generating deceleration fuel quantity data in response to said deceleration command, said deceleration fuel quantity data having a value approximately equal to the value of said fuel quantity data required to sustain the engine at its idle speed; and generating said fuel quantity signal in response to said deceleration fuel quantity data.

* * * * *

UNITED STATES PATENT AND TRADEMARK OFFICE

CERTIFICATE OF CORRECTION

PATENT NO. : 5,092,301

DATED : March 3, 1992

INVENTOR(S) : Arthur J. Ostdiek

It is certified that error appears in the above-identified patent and that said Letters Patent is hereby corrected as shown below:

Column 4, line 62, delete "computer" and insert ---- compute ----.

Column 5, line 31, delete "t-t_" and insert ---- t-t_i ----.

Column 5, line 47, after "engine" insert ---- , ----.

Column 5, line 48, after "60" insert ---- , ----.

Column 6, line 19, delete "comput" and insert ---- compute ----.

Column 6, line 33, delete "look up" and insert ---- look-up ----.

Column 7, line 51, delete "(-" and insert ---- ( ----.

Column 7, line 54, delete "valve" and insert ---- value ----.

Column 9, line 5, delete "data" and insert ---- date ----.

Figure 4 should appear as shown on the attached sheet.

Signed and Sealed this

Twenty-ninth Day of June, 1993

*Attest:*

*Attesting Officer*

Michael K. Kirk

MICHAEL K. KIRK

*Acting Commissioner of Patents and Trademarks*